US011311157B2

(12) United States Patent
Shinma et al.

(10) Patent No.: US 11,311,157 B2
(45) Date of Patent: Apr. 26, 2022

(54) CLEANER

(71) Applicant: MAKITA CORPORATION, Anjo (JP)

(72) Inventors: Yasutoshi Shinma, Anjo (JP); Akinori Ito, Anjo (JP)

(73) Assignee: MAKITA CORPORATION, Anjo (JP)

( * ) Notice: Subject to any disclaimer, the term of this patent is extended or adjusted under 35 U.S.C. 154(b) by 230 days.

(21) Appl. No.: 16/458,263

(22) Filed: Jul. 1, 2019

(65) Prior Publication Data

US 2020/0000299 A1 Jan. 2, 2020

(30) Foreign Application Priority Data

Jul. 2, 2018 (JP) ..... JP2018-125897

(51) Int. Cl.

| | |
|---|---|
| ***A47L 5/36*** | (2006.01) |
| ***A47L 9/28*** | (2006.01) |
| ***A47L 9/14*** | (2006.01) |
| ***A47L 9/24*** | (2006.01) |

(52) U.S. Cl.

CPC ..... *A47L 5/362* (2013.01); *A47L 9/1427* (2013.01); *A47L 9/1472* (2013.01); *A47L 9/248* (2013.01); *A47L 9/2884* (2013.01)

(58) Field of Classification Search

CPC ..... A47L 5/362; A47L 9/1427; A47L 9/1472; A47L 9/248

See application file for complete search history.

(56) References Cited

U.S. PATENT DOCUMENTS

| | | | | |
|---|---|---|---|---|
| 2005/0102790 | A1 | 5/2005 | Matsuno et al. | |
| 2016/0015227 | A1 | 1/2016 | Conrad et al. | |
| 2017/0245705 | A1* | 8/2017 | Son | A47L 5/36 |
| 2017/0245716 | A1* | 8/2017 | Son | A47L 9/242 |
| 2017/0258282 | A1* | 9/2017 | Shinagawa | A47L 9/2857 |
| 2019/0307301 | A1* | 10/2019 | Conrad | A47L 5/362 |

FOREIGN PATENT DOCUMENTS

| | | | |
|---|---|---|---|
| CN | 1642465 | A | 7/2005 |
| CN | 105361798 | A | 3/2016 |
| EP | 3210512 | A1 | 8/2017 |
| JP | S64-023950 | U | 2/1989 |
| JP | H01-221131 | A | 9/1989 |
| JP | H03-047225 | A | 2/1991 |
| JP | H06-003260 | U | 1/1994 |

(Continued)

OTHER PUBLICATIONS

Jun. 17, 2021 Office Action issued in Chinese Patent Application No. 2019-10417990.1.

(Continued)

*Primary Examiner* — Marc Carlson
(74) *Attorney, Agent, or Firm* — Oliff PLC

(57) ABSTRACT

An electric motor serving as a drive source of a dust collection mechanism 20 is arranged such that a motor axis line of the electric motor is tilted with respect to a base portion of a main body case. Because of this configuration, a main body is made to be compact in the front-to-rear direction, in comparison to a configuration where the motor axis line of the electric motor is disposed parallel to the base portion.

19 Claims, 9 Drawing Sheets

(56) References Cited

FOREIGN PATENT DOCUMENTS

| | | | | | |
|---|---|---|---|---|---|
| JP | 2000-014608 | A | | 1/2000 | |
| JP | 2004-215904 | A | | 8/2004 | |
| JP | 2007-082786 | A | | 4/2007 | |
| JP | 2009095458 | A | | 5/2009 | |
| JP | 20100029401 | A | | 2/2010 | |
| JP | 2010-075471 | A | | 4/2010 | |
| JP | S44-004625 | Y | | 1/2014 | |
| JP | 2014-176567 | A | | 9/2014 | |
| JP | 2014176567 | A | * | 9/2014 | ..... A47L 5/24 |
| JP | 2014-200325 | A | | 10/2014 | |
| JP | 2015096132 | A | * | 5/2015 | |
| JP | 2018-082895 | A | | 5/2018 | |
| WO | 2004010839 | A1 | | 2/2004 | |
| WO | WO-2015157336 | A1 | * | 10/2015 | ..... A47L 5/362 |
| WO | WO-2017068679 | A1 | * | 4/2017 | ..... A47L 9/0477 |

OTHER PUBLICATIONS

Nov. 25, 2021 Office Action issued in Chinese Patent Application No. 2019-10417990.1.
Feb. 17, 2022 Office Action issued in Japanese Patent Application No. 2018-125897.

* cited by examiner

CLEANER

CROSS-REFERENCE

This application claims priority to Japanese patent application serial number 2018425897, filed on Jul. 2, 2018, the contents of which are incorporated herein by reference in their entirety;

TECHNICAL FIELD

The present invention generally relates to a cleaner, for instance a vacuum cleaner.

BACKGROUND ART

AC-powered cleaners, as well as rechargeable cleaners, have been known and widely used for years for cleaning purposes. In an AC-powered cleaner, it is required to connect a power cord thereof to a power outlet. This is not required for a rechargeable cleaner. Accordingly when cleaning is conducted in a vehicle cabin or in a vehicle cargo compartment by using the rechargeable cleaner; better usability can be achieved, compared to using the AC-powered cleaner. Furthermore, it is often easier to carry a rechargeable cleaner than an AC-powered cleaner. Japanese Laid-Open Patent Publication No. 2014476567 discloses a cleaner that is powered by a rechargeable battery.

In the cleaner disclosed in the above-described patent publication, which is one version of a cleaner powered by a rechargeable battery, a dust collection nozzle is configured to be integrally formed with a cleaner main body; the cleaner main body being provided with a battery attachment portion. Thus, when cleaning is conducted, it may be necessary to move an entire cleaner, including the main body in order to move the dust collection nozzle. In this respect, when this type of rechargeable cleaner, which is sometimes referred to as a stick-type cleaner or a nozzle-integrated-type cleaner; is used in a relatively small space, such as, for example, in the vehicle cabin or in the vehicle cargo compartment, usability may be decreased. Alternatively; in a rechargeable cleaner in which a dust collection nozzle is attached to a cleaner main body via a flexible hose, which is sometimes referred to as a nozzle-separation-type cleaner, cleaning can be conducted such that only the dust collection nozzle is moved, without the cleaner main body also being moved. Thus, improved usability can be achieved in a nozzle-separation-type cleaner, in comparison to the nozzle-integrated-type cleaner. However, nozzle-separation-type cleaners are bulky, thereby making it difficult to store. This can be especially problematic when storage space is limited, such as in a vehicle.

Therefore, there is a need for a rechargeable, nozzle-separation-type cleaner in which the dust collection nozzle is attached to the cleaner main body via the hose that has improved compactness.

SUMMARY

In one exemplary embodiment of the present disclosure, a cleaner comprises a main body that houses a dust collection mechanism powered by an electric motor as a drive source, a hose that is connected to a hose connection port that is provided in the main body, and a dust collection nozzle that is connected to a tip end of the hose. Furthermore, the electric motor is housed in the main body so as to be tilted with regard to a base portion of the main body.

According to this embodiment, the cleaner is made to be compact in a direction of the base portion of the main body, in comparison to a configuration where the electric motor is disposed parallel to the base portion.

In another exemplary embodiment of the present disclosure, the main body includes a battery attachment portion to which a rechargeable battery is attached, and the rechargeable battery is attached to and detached from the battery attachment portion in a horizontal direction.

According to this embodiment, an attachment space for attaching the battery pack is made to be compact in the up-to-down direction, in comparison to a configuration where the battery pack is attached to and detached from the up-to-down direction.

In another exemplary embodiment of the present disclosure, the base portion of the main body includes a leg.

According to this embodiment, the main body can be placed in a stable manner. Furthermore, the leg may serve as a guard against surrounding objects.

In another exemplary embodiment of the present disclosure, the main body includes an exhaust port from which a dust collection airflow generated by driving of the dust collection mechanism is discharged. Furthermore, the main body also includes a protrusion that is provided in the main body such that when the exhaust port faces an installation surface, the protrusion contacts the installation surface and a gap is formed between the exhaust port and the installation surface.

According to this embodiment, when the main body is placed such that the exhaust ports face the installation surface, the protrusion contacts the installation surface, and thus the exhaust ports is not blocked by the installation surface. As a result, exhausting efficiency and suction power can be maintained.

In another exemplary embodiment of the present disclosure, the main body includes a dust bag housing portion that houses a dust bag that is connected to the hose connection port. The main body also includes a cover by which the dust bag housing portion is opened and closed. Furthermore, when the dust bag is not housed in the dust bag housing portion, the cover is configured not to be completely closed.

According to this embodiment, when the dust bag is not attached to the dust bag housing portion, the cover cannot be closed. Thus, a user can recognize a fact that that the dust bag is not attached to the bag housing portion.

In another exemplary embodiment of the present disclosure, a cleaner comprises a main body that houses a dust collection mechanism powered by an electric motor as a drive source, a hose connected to a hose connection port provided in the main body, and a dust collection nozzle connected to a tip end of the hose. Furthermore, the electric motor is housed in the main body so as to be tilted with regard to a base portion of the main body. An intermediate portion of the hose is configured to be held at a front portion of the main body. Furthermore, a total length of the main body and the intermediate portion of the hose when held at the front portion of the main body is less than 360 mm, the total height thereof is less than 210 mm, and a total width thereof is less than 140 mm including the hose that is held at the front portion of the main body.

According to this embodiment, the cleaner is made to be compact.

In another exemplary embodiment, a cleaner comprises a main body, a dust bag housing portion located within the main body and being configured to receive a dust bag. The main body also comprises a stopper pivotably connected to a side wall of the main body, such that an engagement portion thereof is biased towards the side wall of the main body.

According to this embodiment, the stopper portion may interfere with the closing of a cover when the dust bag has not been received by the dust bag housing portion. Accordingly, a user array be able to determine if the dust bag has not been installed before using the cleaner.

DETAILED DESCRIPTION

The detailed description set forth below, when considered with the appended drawings, is intended to be a description of exemplary embodiments of the present invention and is not intended to be restrictive and/or to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, these specific details refer to well-known structures, components and/or devices that are shown in block diagram form in order to avoid obscuring significant aspects of the exemplary embodiments present herein.

Figure 4:
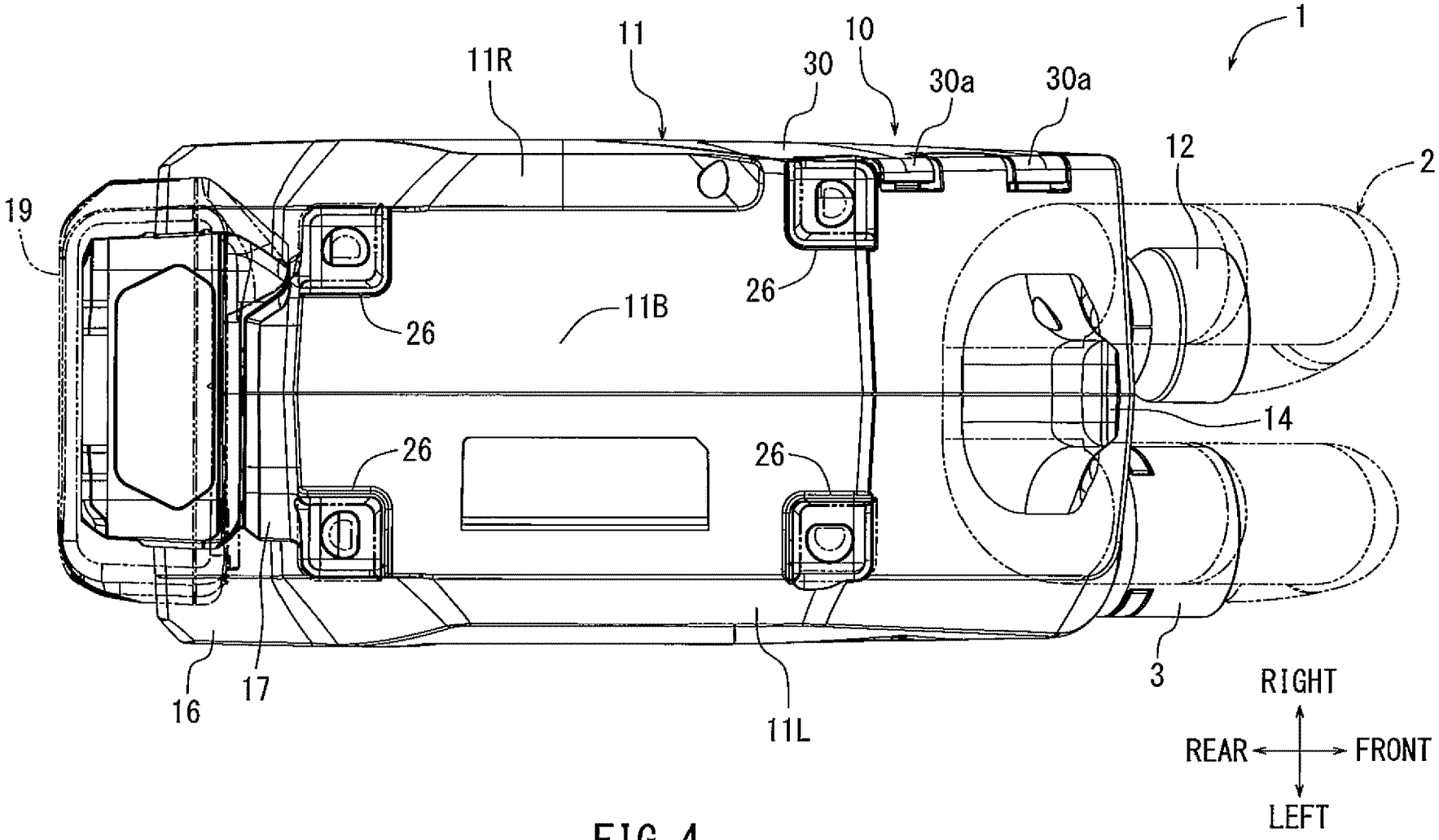
FIG. 4 is a perspective bottom view of the cleaner according to the exemplary embodiment, which is viewed in the direction indicated by an arrow (IV) in FIG. 2.
Figure 5:
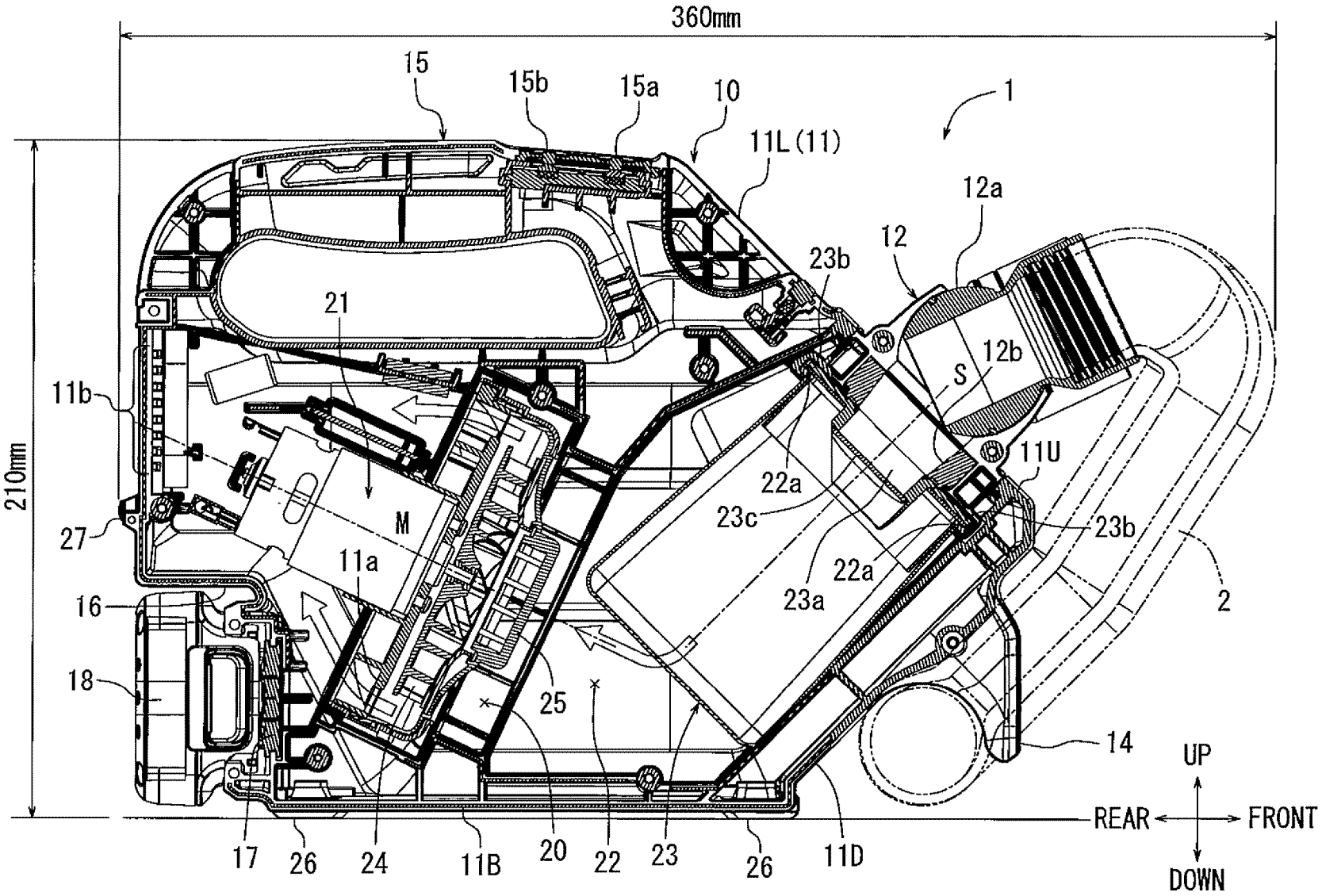
FIG. 5 is a cross-sectional view taken along line (V)-(V) of FIG. 3, showing a longitudinal sectional view of the cleaner according to the exemplary embodiment.

Representative, non-limiting embodiments according to the present disclosure will be described with reference to FIGS. 1 to 9. As shown in FIG. 5, a cleaner 1 in the exemplary embodiment of the present disclosure may include a main body 10 in which a dust collection mechanism 20 is housed. The dust collection mechanism 20 may be driven by an electric motor 21 serving as a drive source. The dust collection mechanism 20 may be housed in a main body case 11 that is formed by combining a half-split left case 11L with a half-split right case 11R.

As shown in FIG. 5, a front portion of the main body case 11 may be formed to protrude in a mountain shape when viewed from a side thereof. An upper inclination portion 11U, that is inclined obliquely in the upward direction as it extends rearwards, may be formed on the upper side of the protruding portion formed in the mountain shape. A lower inclination portion 11D, that is inclined obliquely in the downward direction, may be formed on the lower side of the protruding portion formed in the mountain shape. A hose connection port 12, to which a flexible hose 2 can be connected, may be formed on the upper inclination portion 11U. The hose connection port 12 may mainly include a spherical connection body 12*a* to Which one end of the hose 2 can be connected, so as to be rotatable in a freely-selected direction, within a predetermined angle. A dust collection nozzle 3 can be attached to the other end of the hose 2. The dust collection nozzle 3 can be inserted to and held in a nozzle housing portion 13 that is formed adjacent to the hose connection port 12, as shown in FIGS. 1 and 3.

Figure 1:
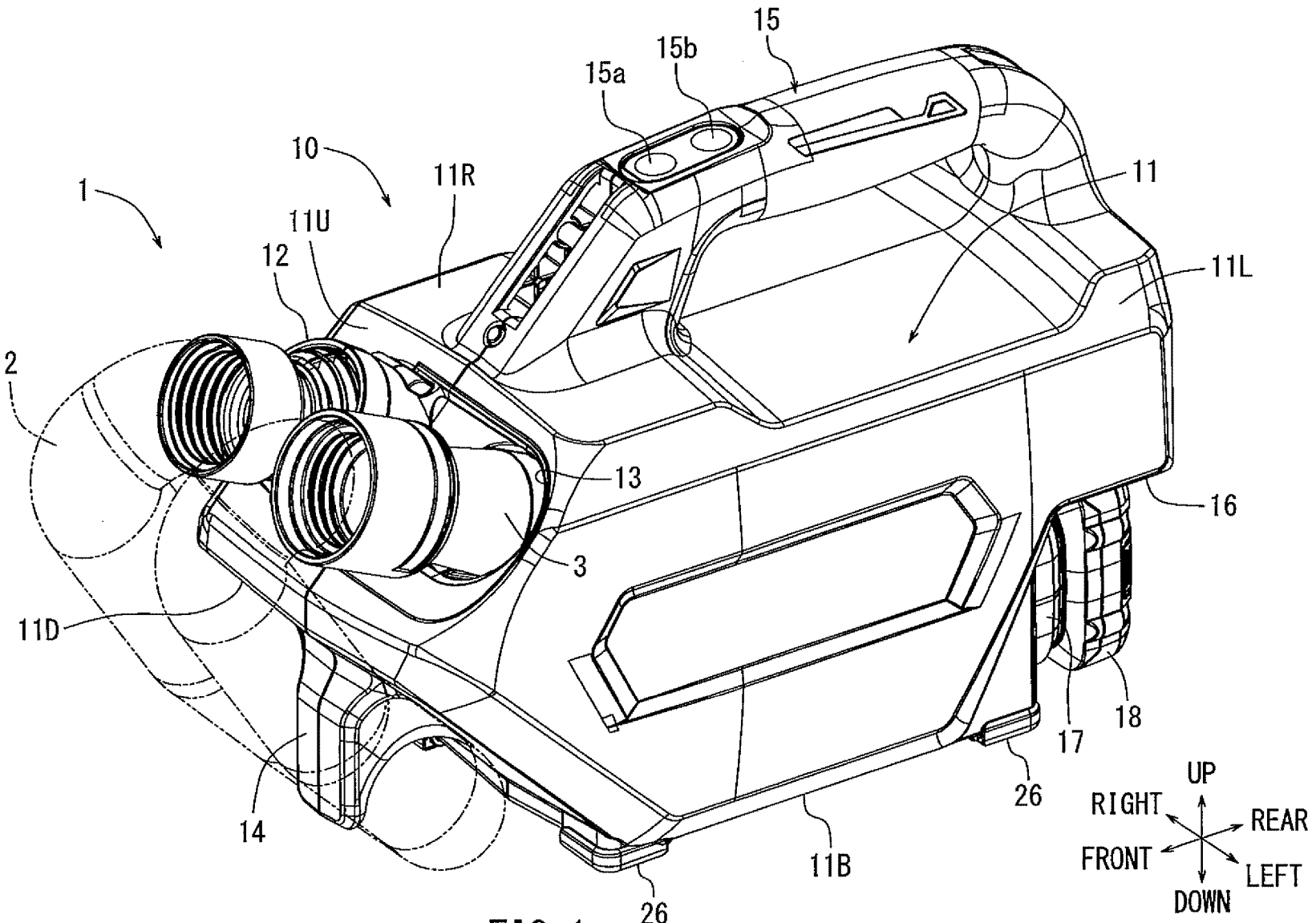
FIG. 1 is an overall perspective view of a cleaner according to an exemplary embodiment of the present disclosure, which is obliquely viewed from a forward left direction.

As shown in FIGS. 1 and 5, a hose holding portion 14 is formed on the lower inclination portion 11D on the front portion of the main body case 11. An intermediate portion of the hose 2 may be engaged with and held by the hose holding portion 14. The dust collection nozzle 3 may be housed in the nozzle housing portion 13 and the intermediate portion of the hose 2 may be held on a front face of the main body 10 via the hose holding portion 14. As a result, when the cleaner 1 is not used, the cleaner 1 may be stored in a compact manner. When the cleaner 1 is used, the hose 2 may be removed from the hose holding portion 14 and the dust collection nozzle 3 may be taken out of the nozzle housing portion 13.

Figure 2:
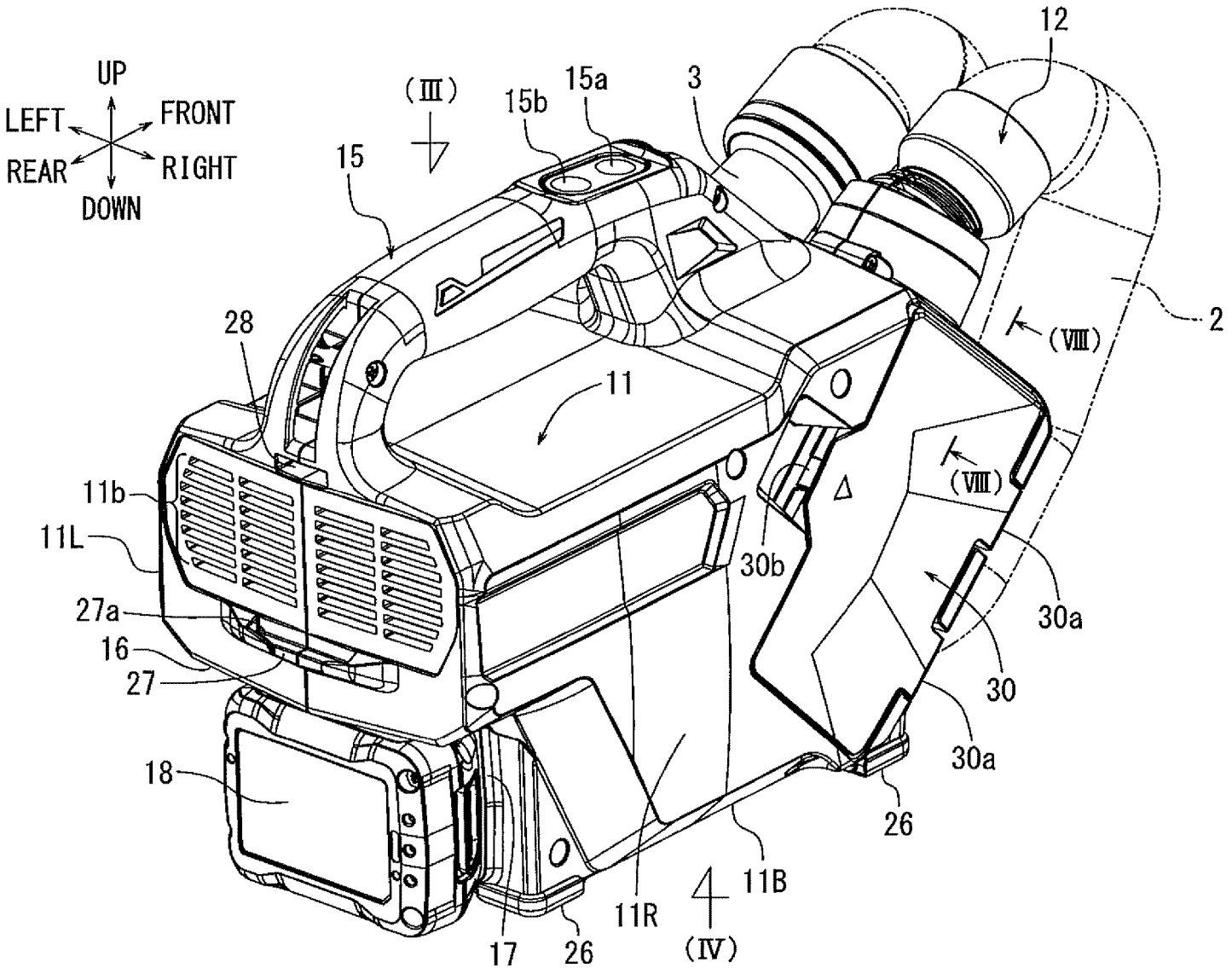
FIG. 2 is an overall perspective view of the cleaner according to the exemplary embodiment, which is obliquely viewed from a rearward right direction.
Figure 3:
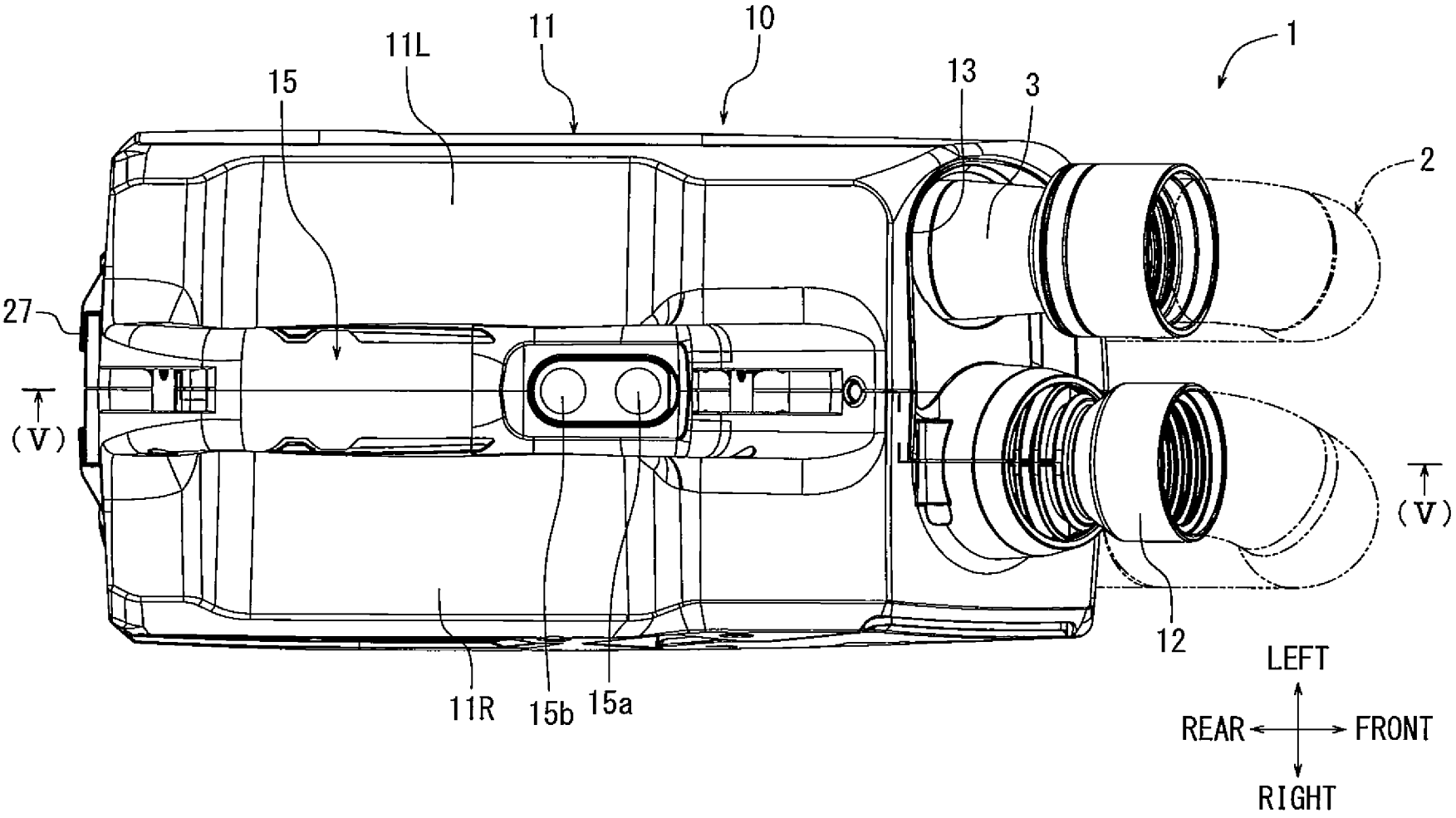
FIG. 3 is a perspective top view of the cleaner according to the exemplary embodiment, which is viewed in the direction indicated by an arrow (III) in FIG. 2.

As shown in FIGS. 1 to 3, a loop-shaped handle 15 may be formed extending in the front-to-rear direction on the upper surface of the main body case 11. A start/stop switch 15*a* for starting/stopping the cleaner 1 and a selection switch 15*b* for selecting a strong/weak suction power of the cleaner 1 may be formed on the upper surface of the handle 15.

Figure 6:
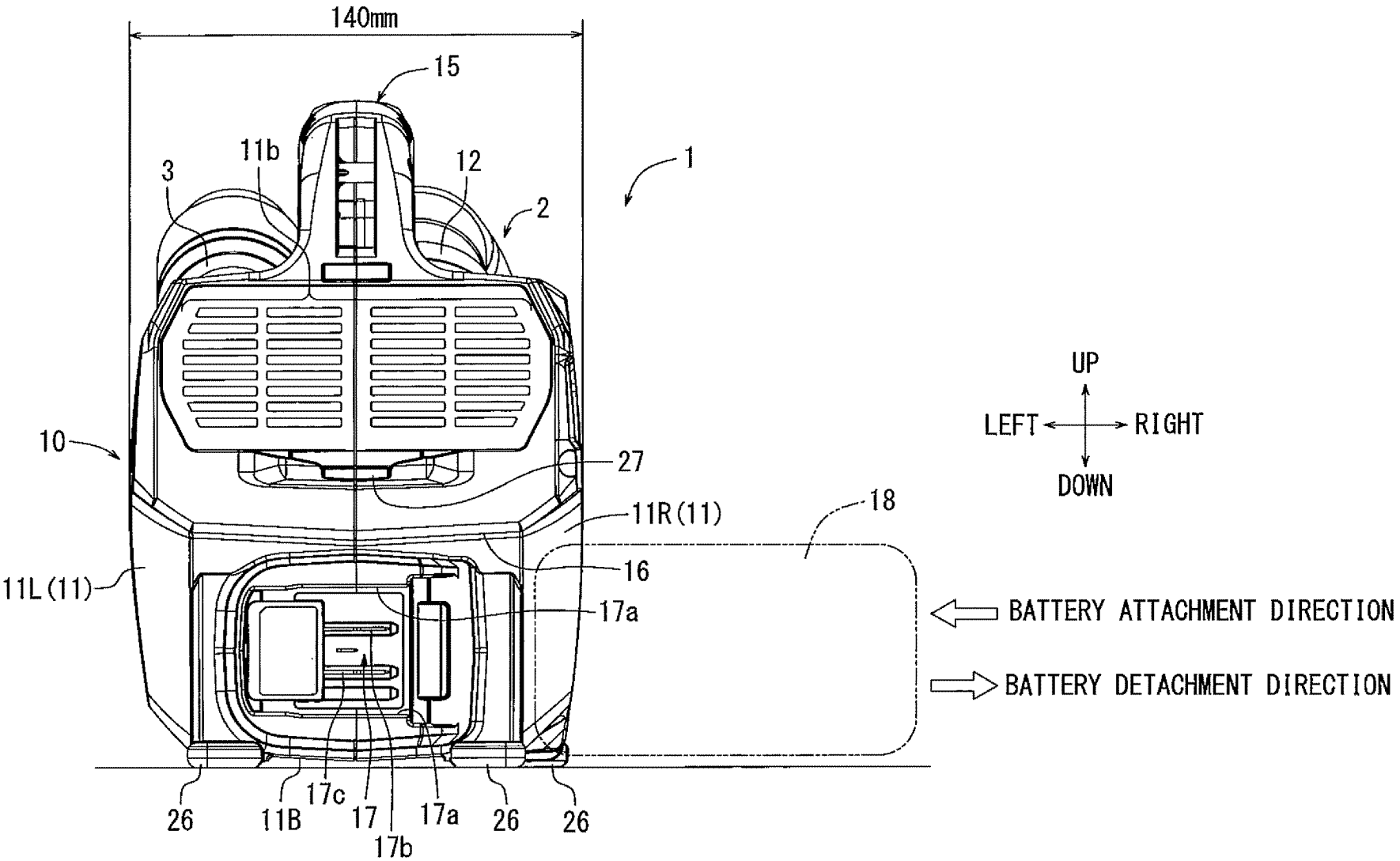
FIG. 6 is a rear view of the cleaner according to the exemplary embodiment, showing that a battery pack is removed from the cleaner.

A stepped portion 16 that is recessed by a predetermined depth in the forward direction may be formed in the lower portion on the rear surface side of the main body case 11. A battery attachment portion 17 may be formed on the front side surface of the stepped portion 16. As shown in FIG. 6, a pair of upper and lower rails 17*a* may be formed on the battery attachment portion 17. A positive terminal 17*b* and a negative terminal 17*c* may be formed between the pair of upper and lower rails 17*a*. A battery pack 18 may be attached to the battery attachment portion 17. Electric power from the battery pack 18 may be used for driving the electric motor 21.

The battery pack 18 may be attached to the battery attachment portion 17 by sliding the battery pack 18, for example, from the right to the left as shown in an outlined arrow in FIG. 6. The attached battery pack 18 may be removed from the battery attachment portion 17 by sliding the battery pack 18 in the rightward direction.

The battery pack 18 may be, for example, a lithium-ion battery whose rated voltage is 10.8 volts and whose capacity is 1.5 Ah (ampere hour). By recharging the battery pack 18 with a separately-prepared dedicated charger, it can be repeatedly used. The battery pack 18 may be very versatile, and it can be utilized as a power source for a rechargeable electric power tool such as, for example, a screw driver.

As shown in FIGS. 1, 2, and 5, the battery pack 18, whose capacity may be relatively low such as, for example, 1.5 Ah, may be attached to the main body 10. The rear surface of the battery pack 18 may be approximately flush with and not protrude beyond the rear surface of the main body 10. FIG. 4 shows that instead of the 1.5 Ah battery pack 18, a high capacity battery pack 19, whose rated voltage is 10.8 volts and whose capacity is 4.0 Ah, may be attached to the battery attachment portion 17. By using the high capacity battery pack 19, the cleaner 1 may be used for a longer time period.

As shown in FIG. 5, a dust bag housing portion 22 may be provided towards the front side of the main body case 11. A dust bag 23 may be attached to the dust bag housing portion 22. A dust collection means for the dust bag 23 may be, for example, a mesh-filter-type or a paper-pack-type bag. The dust bag 23 may be attached to the hose connection port 12 via an adapter 23*a* that has essentially a tubular dust collection port. The dust bag 23 may include upper and lower attachment edges 23*b*. The dust bag 23 may be suspended in the dust bag housing portion 22 by the upper and lower attachment edges 23*b*. An edge of the dust bag 23 may be inserted into a U-shaped attachment groove 22*a*. The adapter 23*a* for the dust bag 23 may have approximately the same diameter as a dust collection port 12*b* of the hose connection port 12, and may be arranged coaxially with the dust collection port 12*b*. A rubber check valve 23*c* for preventing a back flow of collected dust from the dust bag may be provided in the adapter 23*a*. In the following explanation, an axial line of the dust collection port 12*b* may be referred to as a dust collection axis line S. The one end of the hose 2 may be connected to the hose connection port 12 so as to be rotatable in approximately all directions with respect to the dust collection axis line S.

The dust collection mechanism 20 may be arranged behind the dust bag housing portion 22. The dust collection mechanism 20 may include an electric motor 21 serving as a drive source, a dust collection fan 24 that is rotated by the electric motor 21, and a fan case 25 that covers the dust collection fan 24. The electric motor 21 may be screw fixed to a base stand portion 11*a* that is integrally formed with an inner surface of the main body case 11. As shown in FIG. 5, the electric motor 21 may be attached to the base stand portion 11*a* such that a motor axis line M of the electric motor 21 is tilted in the upward direction from the front to the rear.

As discussed above, the electric motor 21 may be disposed such that the motor axis line M thereof is non-parallel and/or non-perpendicular to a base portion 11B of the main body case 11. Instead, the motor axis line M may be tilted so as to be displaced in the upward direction, extending from the front to the rear. Because of this configuration, an adequate space can be obtained between the electric motor 21 and the base portion 11B. By utilizing this space, the above-mentioned stepped portion 16 may be provided below at least a portion of the electric motor 21. Accordingly, the tilted arrangement of the electric motor 21 allows the cleaner 1 to be made more compact in the front-to-rear direction. Furthermore, using a configuration where the battery pack 18 is attached to the stepped portion that may be obtained because of the tilted arrangement of the electric motor 21, the cleaner 1 can be made even more compact in the front-to-rear direction.

In some embodiments, the diameter of the fan case 25 may be larger than the length (e.g., the length along the motor axis line M) of the dust collection mechanism 20. Because of the tilting arrangement of the electric motor 21, the larger size of the fan case 25 affecting the size of the cleaner 1 in an up-to-down direction may be mitigated.

As shown in FIGS. 5 and 6, the total length of the main body 10 and the intermediate portion of the hose 2 being held at the main body 10 is 360 mm in the front-to-rear direction, the total height thereof is 210 mm in the up-to-down direction, and the total width thereof is 140 mm in the left-to-right direction.

The dust collection fan 24 may be attached to an output shaft of the electric motor 21. When the electric motor 21 runs, the dust collection fan 24 may rotate. A centrifugal fan may be used as the dust collection fan 24. When the dust collection fan 24 is rotated, a flow of dust collection air may be generated along the dust collection axis line S, extending from the hose 2 to the dust bag 23. Dust may be collected within the interior of the dust bag 23, having passed through the hose 2 by the flow of dust collection air. After the dust is collected in the dust bag 23, the flow of dust collection air may flow obliquely to the dust collection axis S, so as to change a flow direction towards the upward and rearward direction. For example, the direction of the flow of dust collection air may be changed to essentially the direction of a motor axis M of the electric motor 21. The dust collection air may then enter the interior of the fan case 25. In FIG. 5, a flow of dust collection air is indicated by outlined arrows.

The flow of the dust collection air introduced into the interior of the fan case 25 may be guided along the circumference of the fan case 25, so as to flow obliquely, in the upper and lower directions to the rear along the motor axis M of the electric motor 21. A plurality of exhaust ports 11*b* may be provided on the rear surface of the main body case 11 in the vicinity of an area where the axis M of the electric motor 21 intersects with the rear surface of the main body case 11. Dust collection air that flows along the motor axis M of the electric motor 21 may be discharged to the outside of the main body case 11 through the plurality of exhaust ports 11*b*.

As illustrated in FIG. 5, the tilting arrangement of the electric motor 21 may allow the air to flow better around the stepped portion 16. For instance, the dust collection air that flow generally along the motor axis line M is not substantially interfered by the stepped portion. More specifically, the general direction of the dust collection air at this portion of the flow is angled so as to no substantially intersect the stepped portion. Accordingly, the flow be improved, which may improve the efficiency and/or suction power of the cleaner 1.

As shown in FIGS. 2 and 6, the plurality of exhaust ports 11*b* may be disposed to occupy a relatively wide area. For instance, approximately an upper half area of the rear surface of the main body case 11 may comprise the plurality of exhaust ports 11*b*. Because of this configuration, the exhaust efficiency of the dust collection air may be improved. Accordingly, a suction force of the cleaner 1 may be improved.

The configuration in which the plurality of exhaust ports 11*b* are provided in the large area, as discussed above, can be obtained by adopting a configuration in which the battery pack 18 (or 19) is attached to and removed from the battery attaching portion 17 by sliding in the left-to-right direction. For example, a lateral insertion configuration of the battery pack 18 (or 19) may be adopted. By adopting this lateral insertion configuration, the battery attachment portion 17 can be arranged in the stepped portion 16 provided on approximately the lower half portion of the rear surface of the main body case 11. In some instances, the battery pack 18 (or 19) may have a generally rectangular shape, thereby potentially necessitating a battery attachment portion 17 that has a dimension larger in one direction. By aligning the battery attachment portion 17 such that the battery pack 18 (or 19) may be slidably attached in the lateral direction, the battery attachment portion 17 may be positioned within stepped portion 16. In contrast, in a case where the battery pack 18 (or 19) is attached to and removed from the battery attachment portion 17 in the up-to-down direction (a vertical insertion configuration), the longer dimension of the battery attachment portion 17 may be required to encroach the rear surface of the main body case 11 above the stepped portion 16. This may result in an area for the exhaust ports 11*b* being smaller, thereby reducing the suction force.

A protrusion 27 may be formed below the exhaust ports 11*b* and above the stepped portion 16. The protrusion 27 may be formed so as to protrude in the rearward direction from the rear surface of the main body case 11. When the cleaner 1 is placed such that the rear surface of the main body case 11 is placed on and faces an installation surface, the protrusion 27 may contact the installation surface. Because the protrusion 27 contacts the installation surface, the exhaust ports 11*b* may not be substantially blocked by the installation surface. Because of this configuration, the cleaner 1 may be used in a manner such that the rear surface of the main body 10 faces a vehicle floor, a sheet surface, etc.

Elastic rubber legs 26 may be attached to the base portion 11B of the main body case 11. As shown in FIG. 4, each of the legs 26 may be provided to cover one of the corners of the base portion 11B. The legs 26 may be attached not only to the base portion 11B of the main body case 11, but also be attached so as to cover a part of the side surfaces, for example in the front-to-rear and in the left-to-rear direction. Because of the presence of the four legs 46, the cleaner 1 may be placed in a stable manner. The cleaner 1 may also be prevented firm being hit against its surrounding objects. For instance, the legs 26 may also serve a guard against the surround objects.

As shown in FIG. 2, a rectangular flat-shaped cover 30 may be attached to the front right side of the main body case 11. When the cover 30 is opened, the above-mentioned dust bag housing portion 22 may be exposed to the outside. When the dust bag housing portion 22 is exposed, the dust bag 23 may be attached to and detached from the cleaner 1.

The cover 30 may be held by an opening of the dust bag housing portion 22 so as to be rotatable in generally the up-to-down direction about two hinges 30*a* disposed on the lower side of the cover 30. When the cover 30 is disengaged from the two hinges 30*a*, the cover 30 may be removed from the main body case 11. A closing claw 30*b*, which is used for locking a closed state of the cover 30 by engaging with the opening of the dust bag housing portion 22, may be formed in the upper portion of the cover 30. By the closing claw 30*b* being elastically engaged with the opening of the dust bag housing portion 22, the cover 30 may be held at a closed position.

Figure 8:
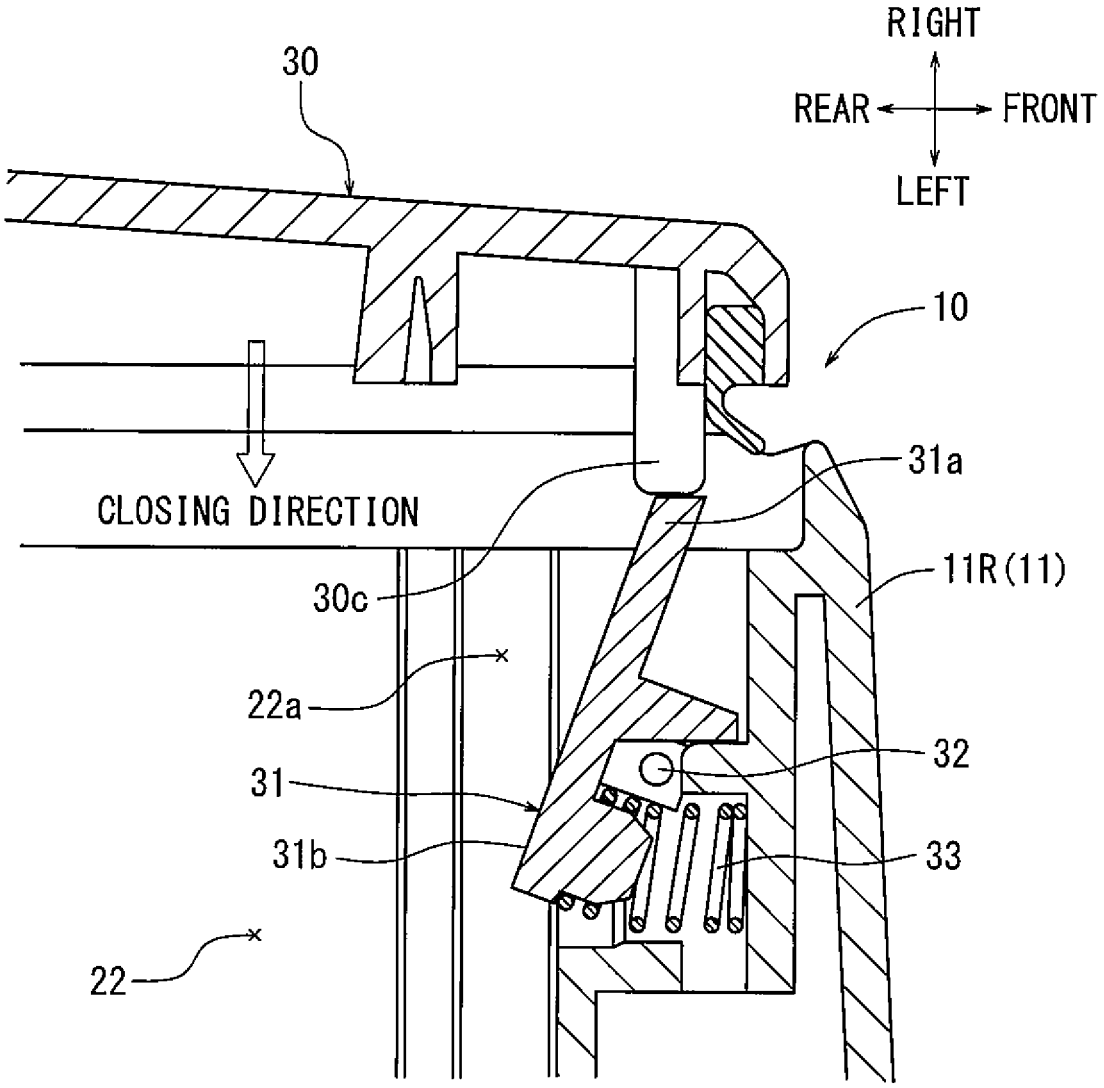
FIG. 8 is a cross-sectional view taken along line (VIII)-(VIII) of FIG. 2, showing a cover closure prevention mechanism of the exemplary embodiment, where the cover is opened.
Figure 9:
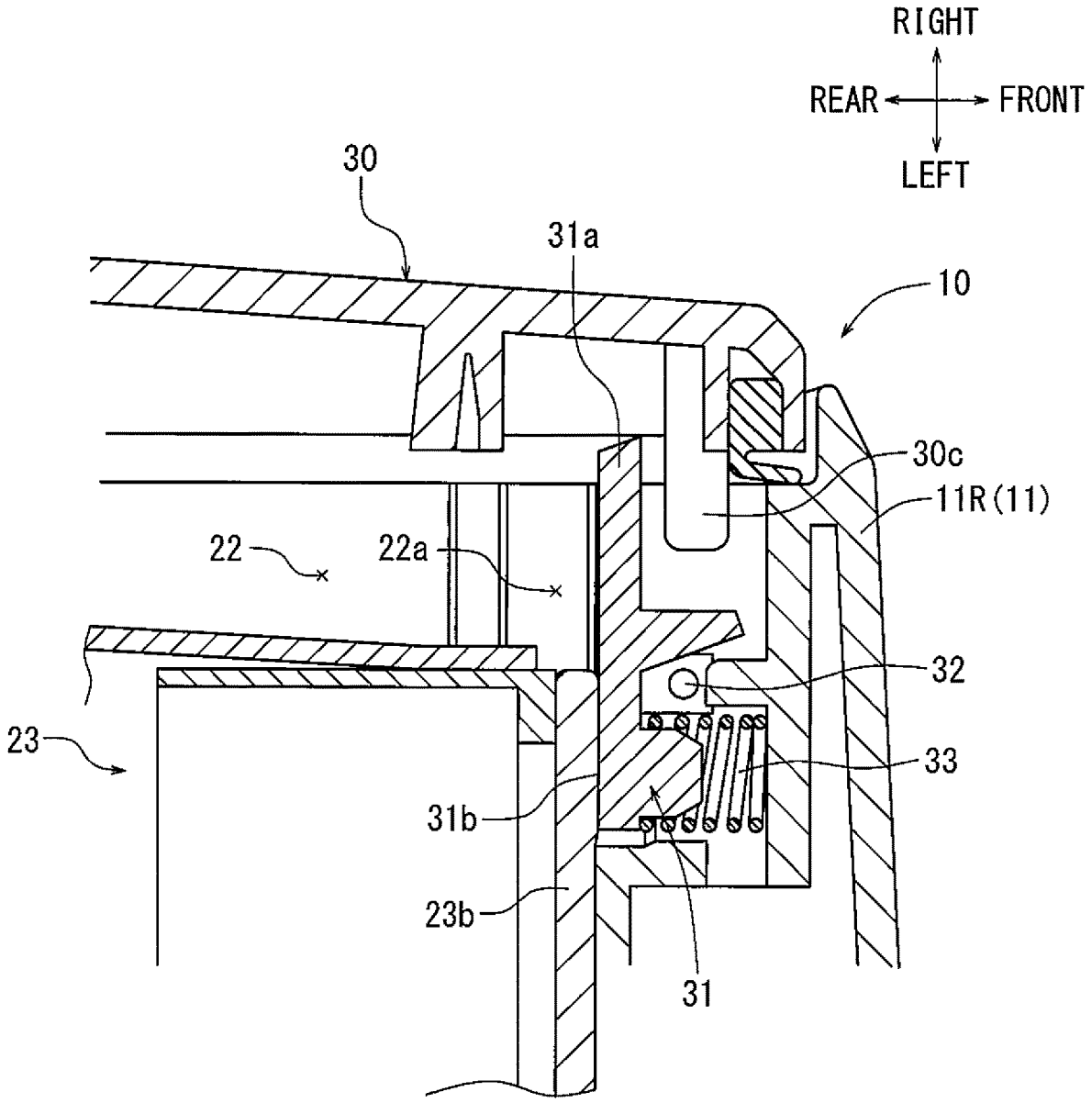
FIG. 9 is the same cross-sectional view as FIG. 8, but shows that the cover is closed.

As shown in FIGS. 8 and 9, a stopper 31 may be provided in the vicinity of the opening of the dust bag housing portion 22. The stopper 31 may aid in the cover 30 not being able to be closed when the dust bag 23 is not mounted to the dust bag housing portion 22. The stopper 31 may essentially serve as a sensor to detect the presence of the dust bag 23 and to prevent the cleaner 1 from being driven when the dust bag 23 is not mounted to the dust bag housing portion 22.

As shown in FIGS. 8 and 9, the stopper 31 may be supported so as to be tiltable with respect to a side wall of the dust bag housing portion 22, for example tiltable in the front-to-rear direction, via a support shaft 32. A compression spring 33 may be inserted between the stopper 31 and the side wall of the dust bag housing portion 22. The stopper 31 may be biased to rotate around the support shaft 32 in a counterclockwise direction, as shown in FIG. 8. For instance, an engagement portion 31*a* may be biased towards a side wall of the dust bag housing portion 22. As shown in FIG. 8, when the dust bag 23 is removed from the dust bag housing portion 22, in other words, when the attachment edge 23*b* is not present in the attachment groove 22*a* of the dust bag housing portion 22, the stopper 31 may rotate in the clockwise direction due to the biasing force of the compression spring 33. This rotation causes the stopper 31 to move to a locked position of the cover 30. The locked position may prevent the cover 30 from being closed. In the closed state, a detection portion 31*b*, formed on the lower side of the stopper 31, may enter the attachment groove 22*a*. In this state, an engagement portion 31*a*, formed on the upper side of the stopper 31, may move in the frontward direction. Because of this configuration, an engagement edge portion 30*c*, that is provided on an inner surface of the cover 30, may be interfere with by the engagement portion 31*a*. Thus, the cover 30 may be prevented from being moved in a closing direction. An example of the closing direction is shown by an outlined arrow in FIG. 8. As a result, the cover 30 may not completely close. Accordingly, the cleaner 1 may be configured such that when the dust hag 23 is not attached to the cleaner 1, a user cannot close the cover 30. Since the cover 30 cannot be properly closed, the user can recognize that he/she has forgotten to attach a dust bag to the cleaner 1.

In contrast, as shown in FIG. 9, when the dust bag 23 is attached to the dust bag housing portion 22, the attachment edge 23*b* may enter the attachment groove 22*a*. Additionally, the detection portion 31*b* may be pushed in the forward direction, against the biasing force of the compression spring 33. As a result, the stopper 31 may rotate in the counterclockwise direction, as shown in FIG. 9, to move to an unlocked position of the cover 30. The unlocked position of the stopper 31 allows it so the cover 30 may be closed. When the stopper 31 is moved to the unlocked position against the biasing force of the compression spring 33, the engagement portion 31*a* may be moved in the rearward direction, so as not to interfere with the engagement edge portion 30*c* of the cover 30 when being closed. As a result, the cover 30 can be completely closed.

Figure 7:
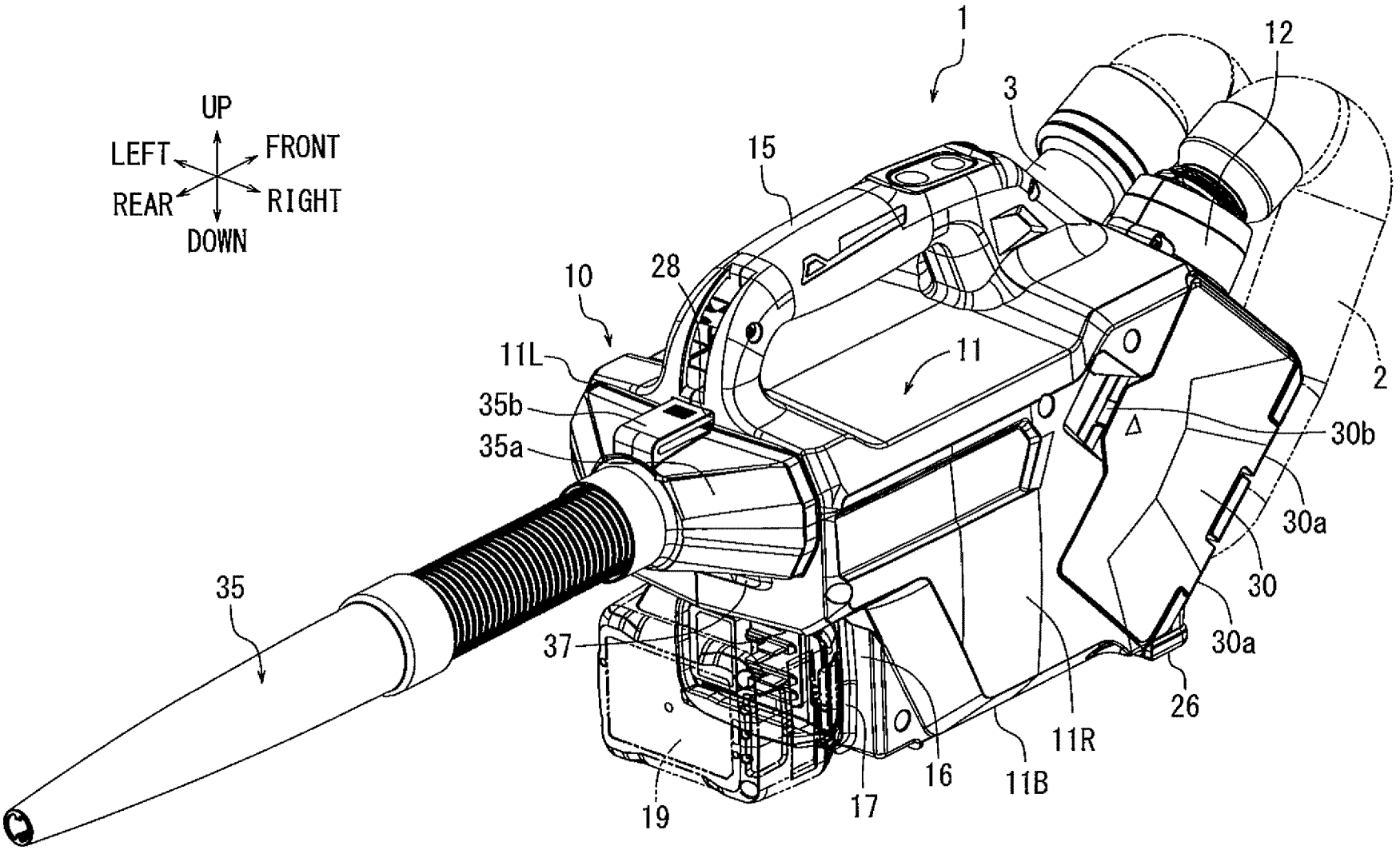
FIG. 7 is an overall perspective view of the cleaner according to the exemplary embodiment, which is obliquely viewed from the rearward right direction and shows that a blower nozzle is attached to the cleaner.

As shown in FIG. 2, an upper engagement recess 28 opening in the rearward direction may be formed on the upper rear side of the main body case 11, above the exhaust ports 11*b*. A lower engagement recess 27*a* opening in the upward direction may be formed in the above-discussed protrusion 27. As shown in FIG. 7, a blower duct 35 may be attached to the rear surface of the main body 10 by using the upper and lower engagement recesses 28, 27*a*.

As shown in FIG. 7, the blower duct 35 may include a junction 35*a* that covers all of the exhaust ports 11*b*. In FIG. 7, the junction 35*a* has a rectangular cup-shaped junction. Furthermore, a claw portion 35*b*, that can be elastically engaged with the upper engagement recess 28, may be provided on the upper side of the junction 35*a*. An engagement edge portion (not shown in the figures), which can be inserted into the lower engagement recess 27*a*, may be provided on the lower side of the junction 35*a*. By inserting the lower-side engagement edge portion into the lower engagement recess 27*a* and engaging the upper-side claw portion 35*b* with the upper engagement recess 28, the blower duct 35 ray be attached to the rear surface of the main body 10 extending in the rearward direction.

Dust collection air that is discharged from the plurality of the exhaust ports 11*b* may be ejected from a tip end of the blower duct 35. Mud that is attached to, for example, a floor mat or a tire of a vehicle may be blown away with the dust collection air ejected from the blower duct 35. In this way, the cleaner 1 may also be used for a blower, by attaching the blower duct 35 to the rear surface of the main body 10. When the cleaner 1 is used for the blower, the user may hold the handle 15 such that the blower duct 35 extends in the forward direction when viewed from the user's position.

According to the above-described cleaner 1 of the present embodiment, the electric motor 21 may be housed so as to be tilted with regard to the base portion 11B of the main body case 11. Because of this configuration, the main body 10 may be compact in the front-to-rear direction of the base portion 11B of the main body 10, in comparison to a configuration where an electric motor is disposed parallel or perpendicular to the base portion 11B.

Furthermore, the battery pack 18 (or 19) may be attached to and detached from the battery attachment portion 17 in the left-to-right direction (e.g., a lateral insertion configuration). Because of this configuration, the attachment space for the battery pack 18 (or 19) may be compact in the up-to-down direction, in comparison to a configuration where a battery pack is attached to and detached from in the up-to-down direction. Furthermore, because of the lateral insertion configuration of the battery pack, the space for the battery attachment portion 17 can be positioned in approximately the lower half of the rear surface of the main body 10. As a result, the exhaust ports 11*b* can be arranged in a larger area, thereby improving the exhaust efficiency and suction force of the cleaner 1.

Furthermore, in the exemplified cleaner 1, the main body 10 can be placed in a stable manner because the elastic rubber legs 26 may be disposed at the four corners of the base portion 11B. Furthermore, the legs 26 may serve as a guard against the surrounding objects, thereby preventing the main body case 11 from being flawed or damaged.

Furthermore, in the exemplified cleaner 1, the protrusion 27 may be formed on the rear surface of the main body 10. When the cleaner 1 is placed such that the rear surface of the main body 10 faces and is on the installation surface, the protrusion 27 may contact the installation surface to generate a gap between the cleaner 1 and the installation surface. As a result, the exhaust ports 11*b* can be prevented from being blocked by the installation surface. This allows the exhaust efficiency and suction force to be maintained.

Furthermore, in the exemplified cleaner 1, when the dust bag 23 is not attached to the dust bag housing portion 22, the stopper 31 may limit a closing movement of the cover 30. As a result, the user can recognize a fact that that the dust bag 23 is not attached to the cleaner 1.

In the cleaner 1 according to the embodiment of the present disclosure, the configuration may not be limited to the above-discussed embodiment, and variations and modifications may be effected without departing from the spirit and scope of the present teachings. In the present embodiment for instance, the stepped portion 16 may be provided on the rear side of the main body case 11, so as to position the battery attachment portion 17 on the front surface of the stepped portion 16. The battery pack 18 (or 19) may then be attached to the battery attachment portion 17, the battery attachment portion 17 being recessed with respect to the rear surface of the case in the forward direction. However, the battery attachment portion 17 may be arranged on the upper surface of the stepped portion 16. Alternatively, the stepped portion 16 may be omitted. Even if the stepped portion 16 is omitted, the tilting arrangement of the electric motor 21 may make the main body 10 more compact in the front-to-rear direction.

In the above-discussed embodiment, the battery pack may be slid in the left-to-right direction. However, the sliding direction of the battery pack may be in the up-to-down direction or alternatively in the front-to-rear direction, according to the desired configurations.

Furthermore, in the exemplified embodiment, the rechargeable battery pack 18 (or 19) may be attached to the cleaner 1. However, the above-discussed arrangement of the electric motor can be applied to embodiments where the rechargeable battery is housed within the cleaner 1.

Furthermore, in the above-discussed embodiment, the hose connection port 12 and the dust bag 23 may be arranged to be tilted along the dust collection axis line S with respect to the base portion 11B. However, the hose connection port 12 and the dust bag 23 may be disposed to be parallel or perpendicular to the base portion 11B.

Furthermore, in the above-discussed embodiment, the legs 26 may be provided at the four corners of the base portion 11B. Alternatively, the legs 26 may extend along the edge portions of the base portion 11B in the front-to-mar and left-to-right. Alternatively, a leg coveting an entirety of the base portion 11B may be used.

Furthermore, in the above-discussed embodiment, the rechargeable cleaner 1 is powered by the battery pack. But the above-discussed embodiment can be applied to an AC-powered cleaner that is powered by the mains power.

What is claimed is:

1. A cleaner, comprising:

a main body having (1) a base portion with a bottom surface that is configured to face and be substantially parallel to a surface on which the cleaner is placed during a cleaning operation by the cleaner, (2) a hose connection port and (3) a handle that forms a loop extending in a first direction;

an electric motor and a dust collection mechanism housed within the main body; and a battery attachment portion configured to receive a rechargeable battery, wherein:

the electric motor and the dust collection mechanism are configured such that the electric motor powers the dust collection mechanism;

a motor axis of the electric motor is non-parallel and non-perpendicular to the bottom surface;

the battery attachment portion is configured such that the rechargeable battery is attached to and detached from the battery attachment portion in a direction parallel to the bottom surface and perpendicular to the first direction; and the battery attachment portion is on a battery attachment surface of the main body that is (1) perpendicular to the bottom surface and (2) between the bottom surface and an exhaust port in the main body aligned with the motor axis.

2. The cleaner according to claim 1, wherein the electric motor and the battery attachment portion are configured such that a portion of the electric motor overlaps the battery attachment portion in a direction perpendicular to the bottom surface.

3. The cleaner according to claim 1, wherein the battery attachment portion is attached to a stepped portion in an external surface of the main body.

4. The cleaner according to claim 1, wherein:

the dust collection mechanism has a dust collection longitudinal axis; and an angle formed by an intersection of the motor axis and the dust collection longitudinal axis that passes through an opening in the hose connection port is oblique.

5. The cleaner according to claim 1, wherein the base portion of the main body includes a leg attached to the bottom surface.

6. The cleaner according to claim 1, wherein the main body includes:

an exhaust port from which a dust collection airflow, generated by driving of the dust collection mechanism, is discharged; and a protrusion extending outwardly from an outer surface of the main body and adjacent the exhaust port.

7. The cleaner according to claim 6, wherein the protrusion includes a lower engagement recess (1) in a top surface of the protrusion and (2) configured to engage a blower duct.

8. The cleaner according to claim 7, wherein:

the protrusion is below the exhaust port; and an upper engagement recess, which is configured to engage the blower duct, is above the exhaust port.

9. The cleaner according to claim 1, wherein the main body includes:

a dust bag housing portion that is configured to house a dust bag connected to the hose connection port; and a cover by which the dust bag housing portion is opened and closed.

10. The cleaner according to claim 9, further comprising a stopper configured to interfere with the cover moving in a closing direction when the dust bag is not housed in the dust bag housing portion.

11. The cleaner according to claim 10, wherein:

the stopper is configured to rotate around a stopper pivot;

a compression spring that biases the stopper to rotate around the stopper pivot is between the stopper and the main body; and the stopper, the cover, the compression spring and the dust bag housing portion are configured such that:

when the cover is not closed, an engagement portion of the stopper at a distal end of the stopper engages an engagement edge portion of the cover due to a biasing force of the compression spring; and when the cover is closed and the dust bag is housed in the dust bag housing portion, the dust bag operatively presses the compression spring to cause the stopper to rotate in a direction opposite to a biasing direction of the compression spring, thereby disengaging the engagement portion of the stopper from the engagement edge portion of the cover.

12. The cleaner according to claim 1, wherein:

the main body includes an exhaust port from which a dust collection airflow, generated by driving of the dust collection mechanism, is discharged from the main body; and the exhaust port is farther from the bottom surface than from the electric motor.

13. The cleaner according to claim 1, further comprising a fan case (1) connected to the main body inside the main body and (2) having a fan axis that is non-parallel and non-perpendicular to the bottom surface.

14. The cleaner according to claim 13, wherein:

the main body includes a dust bag housing portion that is configured to house a dust bag connected to the hose connection port; and a portion of the fan case is located between the battery attachment portion and a dust bag housed in the dust bag housing portion in a direction parallel to the bottom surface.

15. The cleaner according to claim 1, wherein the dust collection mechanism is configured such that a dust collection airflow, generated by driving of the dust collection mechanism, flows between the battery attachment portion and the electric motor.

16. The cleaner according to claim 1, further comprising a hose connected to a hose connection port, wherein:

an intermediate portion of the hose is configured to be held at a front portion of the main body; and a total length of the main body and the intermediate portion of the hose when held at the front portion of the main body is less than 360 mm, a total height thereof is less than 210 mm, and a total width thereof is less than 140 mm.

17. The cleaner according to claim 1, wherein:

the battery attachment portion is in a stepped portion formed in an external surface of the main body; and the stepped portion is defined by (i) the base portion of the main body, (ii) two spaced side surfaces intersecting the base portion of the main body, and (iii) a surface below the exhaust port and parallel to the bottom surface.

18. The cleaner according to claim 17, wherein the battery attachment portion includes a pair of rails configured to guide the rechargeable battery in an attachment direction.

19. The cleaner according to claim 1, wherein the main body, the electric motor and the dust collection mechanism are configured such that a path of a dust collection airflow due to operation of the dust collection mechanism is initially inclined from an air inlet port in the main body toward the bottom surface through a dust bag attached to the hose connection port and then, after passing through the dust bag, inclined away from the bottom surface around the electric motor to the exhaust port.

* * * * *